US010777342B2

(12) United States Patent
Arai et al.

(10) Patent No.: US 10,777,342 B2
(45) Date of Patent: Sep. 15, 2020

(54) COIL COMPONENT AND METHOD FOR MANUFACTURING THE SAME

(71) Applicant: TAIYO YUDEN CO., LTD., Taito-ku, Tokyo (JP)

(72) Inventors: Takayuki Arai, Takasaki (JP); Hirotaro Seino, Takasaki (JP); Shinsuke Takeoka, Takasaki (JP); Natsuko Sato, Takasaki (JP); Masanori Nagano, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 322 days.

(21) Appl. No.: 15/618,009

(22) Filed: Jun. 8, 2017

(65) Prior Publication Data

US 2017/0365386 A1 Dec. 21, 2017

(30) Foreign Application Priority Data

Jun. 15, 2016 (JP) ..... 2016-118681
May 12, 2017 (JP) ..... 2017-095538

(51) Int. Cl.

| | |
|---|---|
| ***H01F 27/28*** | (2006.01) |
| ***H01F 1/147*** | (2006.01) |
| ***H01F 17/00*** | (2006.01) |
| ***H01F 41/04*** | (2006.01) |
| ***H01F 27/245*** | (2006.01) |
| ***H01F 27/255*** | (2006.01) |

(Continued)

(52) U.S. Cl.

CPC ..... *H01F 1/14791* (2013.01); *H01F 17/0013* (2013.01); *H01F 17/0033* (2013.01); *H01F 27/245* (2013.01); *H01F 27/255* (2013.01); *H01F 27/28* (2013.01); *H01F 27/2804* (2013.01); *H01F 27/323* (2013.01); *H01F 41/0233* (2013.01); *H01F 41/041* (2013.01); *H01F 41/046* (2013.01); *H01F 2017/0066* (2013.01); *H01F 2027/2809* (2013.01)

(58) Field of Classification Search

CPC ..... H01F 27/00–40
USPC ..... 336/65, 83, 200, 206–208, 232–234
See application file for complete search history.

(56) References Cited

U.S. PATENT DOCUMENTS 8,362,866 B2 * 1/2013 Matsuura ..... B22F 1/02 336/200
2015/0155093 A1 * 6/2015 Kim ..... H01F 17/0013 336/192

FOREIGN PATENT DOCUMENTS

EP 1486993 A1 * 12/2004 ..... H01F 1/1475
JP H07272935 A 10/1995
JP 2017092431 A * 5/2017 ..... H01F 27/292

* cited by examiner

*Primary Examiner* — Tuyen T Nguyen
(74) *Attorney, Agent, or Firm* — Law Office of Katsuhiro Arai

(57) ABSTRACT

A coil component that can be made thinner while ensuring sufficient magnetic characteristics includes a magnetic part, a conductor part, and multiple insulator parts. The magnetic part is constituted by magnetic alloy grains. The conductor part has multiple winding parts and is wound around one axis inside the magnetic part. The multiple insulator parts are each placed between the multiple winding parts, each having a winding shape that includes two joining surfaces that are respectively joined to two winding parts facing each other at least partially in the direction of the one axis, and are each constituted by electrically insulating grains.

19 Claims, 7 Drawing Sheets

(51) Int. Cl.
*H01F 27/32* (2006.01)
*H01F 41/02* (2006.01)

COIL COMPONENT AND METHOD FOR MANUFACTURING THE SAME

BACKGROUND

Field of the Invention

The present invention relates to a coil component having a magnetic part constituted by magnetic alloy grains, as well as a method for manufacturing the same.

Description of the Related Art

In support of mobile phones offering multiple functions, computerization of cars, and other trends, the so-called "chip-type" small coil components or inductance components have gained wide popularity. In particular, multilayer inductance components (multilayer inductors) have been an object of development efforts in recent years, as these components can be made thinner to support power devices requiring large flows of current.

A multilayer inductor is constituted by alternately formed magnetic layers and internal conductors and, in many cases, the internal conductors are formed as multiple layers. For example, Patent Literature 1 discloses a method for manufacturing multilayer inductors, wherein conductor patterns are printed on ceramic green sheets that contain ferrite, etc., and then these sheets are stacked and sintered together.

BACKGROUND ART LITERATURES

[Patent Literature 1] Japanese Patent Laid-open No. Hei 7-272935

SUMMARY

As electronic devices become increasingly smaller of late, there is a need to make the electronic components installed in these devices, even thinner and smaller than they already are. With the structure described in Patent Literature 1, however, the magnetic sheet present between conductor patterns functions as an electrical insulation layer between the conductor patterns, which makes it difficult to make the component thinner because the magnetic layer must have a specified or greater thickness (distance between patterns) in order to ensure the specified dielectric strength. Also, while it is possible to ensure sufficient dielectric strength by increasing the content of resin component, glass component, and other non-magnetic components in the magnetic layer, doing so results in a relatively lower content of magnetic material, which inevitably causes the magnetic characteristics to drop.

In light of the aforementioned situation, an object of the present invention is to provide a coil component that can be made thinner while ensuring sufficient magnetic characteristics at the same time, as well as a method for manufacturing such coil component.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, a coil component pertaining to an embodiment of the present invention comprises a magnetic part, a conductor part, and multiple insulator parts.

The magnetic part is constituted by magnetic alloy grains.

The conductor part has multiple winding parts and is wound around one axis inside the magnetic part.

The multiple insulator parts are each placed between the multiple winding parts; each have a winding shape that includes two joining surfaces that are respectively joined to two winding parts facing each other at least partially in the direction of the one axis; and are each constituted by electrically insulating grains.

According to the aforementioned coil component, the insulator parts placed between the multiple winding parts that are facing each other in the direction of the one axis are constituted as single layers that are in turn constituted by electrically insulating grains, and therefore the component as a whole can be made thinner, while ensuring sufficient electrical insulation between the winding parts at the same time. Also, according to the aforementioned coil component, the insulator parts have winding shapes that are facing the winding parts at least partially, and this makes it possible to constitute the areas on the inner periphery side and outer periphery side of the winding shapes with the magnetic alloy grains that constitute the magnetic part. This way, desired magnetic characteristics of the coil component can be ensured.

The thickness dimension of each of the multiple insulator parts in the direction of the one axis may be smaller than the thickness dimension of each of the multiple winding parts in the direction of the one axis. This way, the winding parts can have a narrower pitch in between and consequently the component can be made even thinner.

The width dimension of each of the multiple insulator parts measured perpendicularly to the direction of the one axis may be equal to or greater than the width dimension of each of the multiple winding parts measured perpendicularly to the direction of the one axis. This way, stable electrical insulation can be ensured between the winding parts.

The electrically insulating grains may include first magnetic alloy grains having an average grain size of 1 μm or less. This improves the electrical insulation characteristics of the insulator parts, which in turn makes it possible to improve the dielectric strength between the winding parts or make the pitch between the winding parts even narrower.

The magnetic part may be constituted by second magnetic alloy grains whose average grain size is larger than that of the first magnetic alloy grains. This way, the magnetic characteristics of the magnetic part can be improved.

The electrically insulating grains may contain silica grains, zirconium grains, or alumina grains with an average grain size of 1 μm or less. The insulator grains may be ferrite grains. This way, the insulation characteristics of the insulator parts can be improved.

A method for manufacturing a coil component pertaining to an embodiment of the present invention includes forming a first layer which comprises a first insulator part of winding shape which is wound around one axis; a first conductive winding part which is provided on the first insulator part and which has a first end that extends from one end of the first insulator part; and a first magnetic pattern adjoining the inner periphery parts and outer periphery parts of the first insulator part and first winding part.

Formed on the first layer is a second layer which comprises: a second insulator part of winding shape which is wound around the one axis; a second conductive winding part which is provided on the second insulator part and which has a second end that extends from one end of the second insulator part connected to the first end; and a second magnetic pattern adjoining the inner periphery parts and outer periphery parts of the second insulator part and second winding part.

As described above, according to the present invention the component can be made thinner while ensuring sufficient magnetic characteristics at the same time.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 6A is a cross sectional view of FIG. 4 along line A-A, while

DESCRIPTION OF THE SYMBOLS

Figure 1:
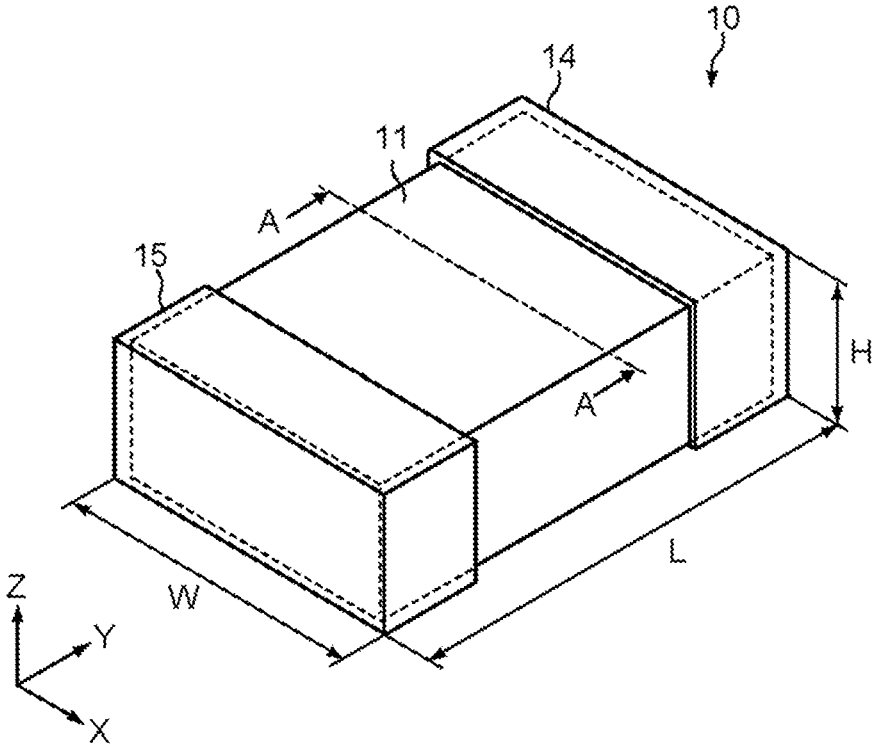
FIG. 1 is a general perspective view of a coil component pertaining to an embodiment of the present invention.

10 - - - Coil component
11 - - - Component body
12 - - - Magnetic part
13 - - - Coil part
14, 15 - - - External electrode
C1 to C4 - - - Winding part
IS1 to IS3 - - - Insulator part
M1 to M4 - - - Magnetic pattern part
ML1 to ML4, MLU, MLD - - - Magnetic layer

DETAILED DESCRIPTION OF EMBODIMENTS

An embodiment of the present invention is explained below by referring to the drawings.

Figure 2:
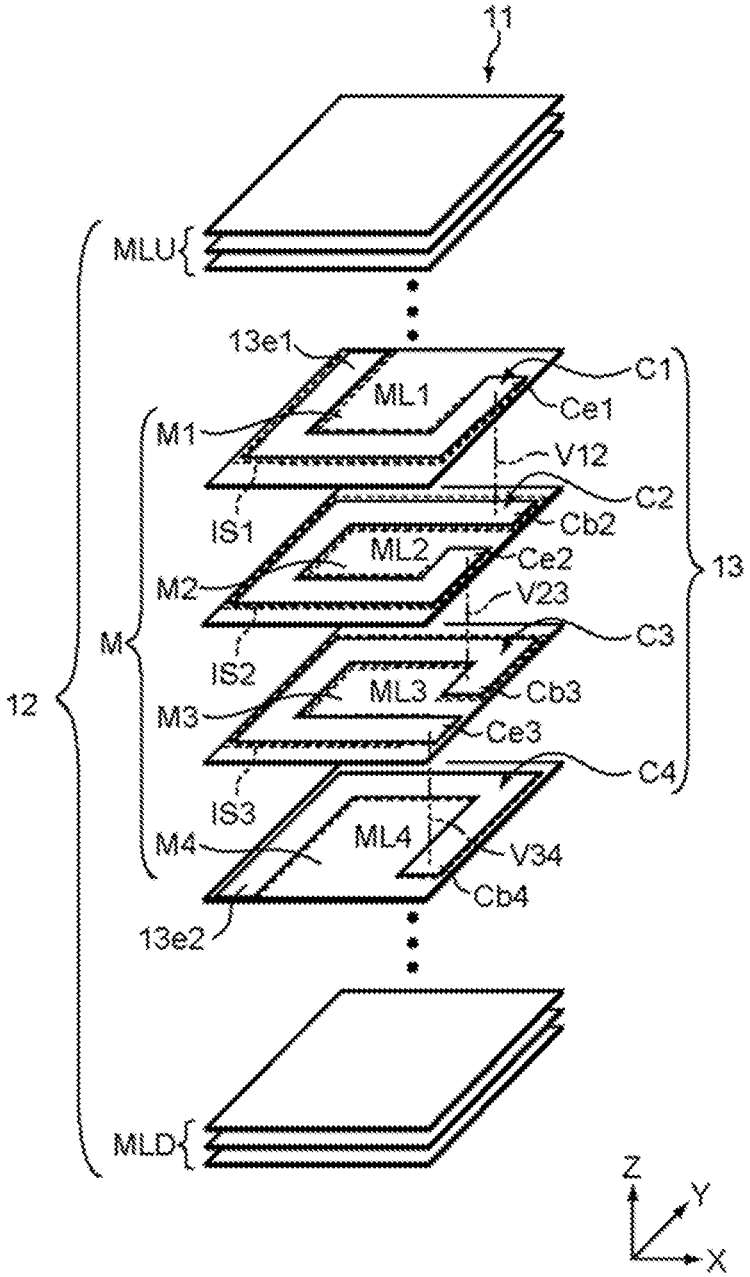
FIG. 2 is an exploded perspective view of the coil component.
Figure 3:
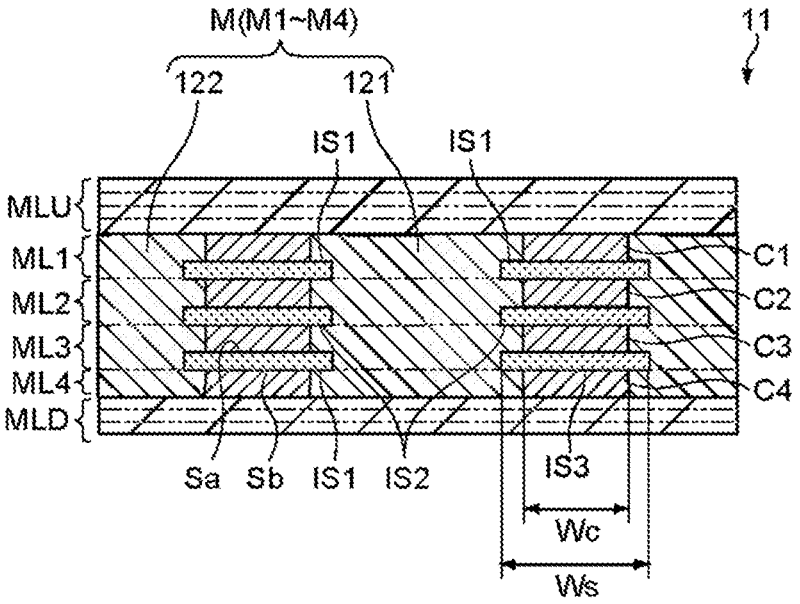
FIG. 3 is a cross sectional view of FIG. 1 along line A-A.

FIG. 1 is a general perspective view of a coil component 10 pertaining to an embodiment of the present invention, FIG. 2 is an exploded perspective view of the coil component 10, and FIG. 3 is a cross sectional view of FIG. 1 along line A-A. The coil component 10 in this embodiment is constituted as a multilayer inductor for power device, for example.

[General Constitution of Coil Component]

The coil component has a component body 11 and a pair of external electrodes 14, 15, as shown in FIG. 1. The component body 11 is formed as a roughly rectangular solid shape of width W in the X-axis direction, length L in the Y-axis direction, and height H in the Z-axis direction. The pair of external electrodes 14, 15 are provided on two opposing end faces of the component body 11 in its length direction (Y-axis direction).

The dimension of each part of the component body 11 is not limited in any way, and in this embodiment, the length L is 1 to 2 mm, width W is 0.5 to 1 mm, and height H is 0.3 to 0.6 mm.

The component body 11 has a magnetic part 12 of roughly rectangular solid shape, and a spiral coil part 13 (conductor part) placed inside the magnetic part 12. The component body 11 is constructed in such a way that multiple magnetic layers MLU, ML1 to ML4, MLD, are stacked in the height direction (Z-axis direction) and integrated together, as shown in FIGS. 2 and 3.

(Magnetic Part)

The magnetic layers MLU, MLD constitute the top and bottom cover layers of the magnetic part 12, respectively. The magnetic layers ML1 to ML3 have winding parts C1 to C3 constituting the coil part 13, magnetic pattern parts M1 to M3 adjoining the inner periphery sides and outer periphery sides of the winding parts C1 to C3, and insulator parts IS1 to IS3, respectively. The magnetic layer ML4 has a winding part C4 constituting the coil part 13, and a magnetic pattern part M4 adjoining the inner periphery side and outer periphery side of the winding part C4.

The magnetic layers MLU, MLD and magnetic pattern parts M1 to M4 constitute the magnetic part 12. The magnetic part 12 is constituted by magnetic alloy grains.

For the magnetic alloy grains, alloy grains of Fe (iron), a first component and a second component are used. The first component is constituted by at least one of Cr (chromium) and Al (aluminum), while the second component is constituted by at least one of Si (silicon) and Zr (zirconium). In this embodiment, the first component is Cr and the second component is Si, which means that the magnetic alloy grains are constituted by FeCrSi alloy grains. The composition of these magnetic alloy grains is typically Cr accounting for 1 to 5 percent by weight, Si accounting for 3 to 10 percent by weight, and Fe accounting for the remainder excluding impurities, for a total of 100 percent by weight.

The magnetic part 12 has a first oxide film that causes magnetic alloy grains to bond with each other. The first oxide film contains the first component and is expressed as $Cr_2O_3$ in this embodiment. The magnetic part 12 also has a second oxide film present between each magnetic alloy grain and the first oxide film. The second oxide film contains the second component and is expressed as $SiO_2$ in this embodiment.

(Coil Part)

The winding parts C1 to C4 constitute the coil part 13. As shown in FIG. 2, the winding parts C1 to C4 each have winding pattern shapes constituting parts of a coil which is wound around the Z-axis. The winding parts C1 to C4 are electrically connected to each other in the Z-axis direction through vias V12, V23, V34, to form the coil part 13. In the example illustrated, the coil part 13 is turned by 3.5 times; however, the number of turns is not limited to the foregoing and can be set in any way as deemed appropriate according to specifications, component size, etc.

Referring to FIG. 2, the winding part C1 has a turn length of 6/8 of a turn, and it has a lead end 13*e*1 connected to the external electrode 14 as well as a connection end Ce1 constituting a part of the via V12. The winding part C2 has a turn length of 7/8 of a turn, and it has a connection end Cb2 connected to the connection end Ce1 as well as a connection end Ce2 constituting the via V23. The winding part C3 has a turn length of 7/8 of a turn, and it has a connection end Cb3 connected to the connection end Ce2 as well as a connection end Ce3 constituting the via V34. The winding part C4 has a turn length of 6/8 of a turn, and it has a connection end Cb4 connected to the connection end Ce3 as well as a lead end 13*e*2 connected to the external electrode 15.

The coil part 13 is constituted by conductive material. The coil part 13 is constituted by a sintered body of conductive paste, for example, and in this embodiment, a silver (Ag) paste is used for the conductive paste. The winding parts C1 to C4 are typically constituted with the same width and thickness in the winding direction, respectively.

(Magnetic Pattern Parts)

The magnetic pattern parts M1 to M4 each have a first area 121 positioned on the inner periphery side of each of the winding parts C1 to C4, and a second area 122 positioned on the outer periphery side of each of the winding parts C1 to C4, and are each formed as a whole to have the same rectangular shape and size as the magnetic layers MLU, MLD (refer to FIG. 3). The thicknesses of the magnetic pattern parts M1 to M4 determine the thicknesses of the magnetic layers ML1 to ML4. Accordingly, the magnetic pattern part M1 has a thickness equal to or greater than the sum of the thickness of the insulator layer IS1 and thickness of the winding part C1.

The magnetic pattern parts M1 to M4 are constituted by FeCrSi magnetic alloy grains as mentioned above. The average grain size of the magnetic alloy grains constituting the magnetic pattern parts M1 to M4 may be the same as, or different from, the average grain size of the magnetic alloy grains constituting the magnetic layers MLU, MLD. The average grain size of the magnetic alloy grains constituting the magnetic pattern part M1 is 1 μm or more but no more than 5 μm, for example.

(Insulator Parts)

The insulator parts IS1 to IS3 are each placed between the winding parts C1 to C4, and each have a winding shape that includes two joining surfaces that are respectively joined to two winding parts facing each other at least partially in the Z-axis direction. In other words, in this embodiment the insulator parts IS1 to IS3 each have a winding pattern shape that includes areas facing the winding parts C1 to C4, and are each constituted by a single layer having two joining surfaces Sa, Sb that are joined to the opposing surfaces of two winding parts facing each other in the Z-axis direction (refer to FIG. 3).

The insulator parts IS1 to IS3 constitute parts of the magnetic layers ML1 to ML3. An example of the constitution of the insulator part IS1 provided in the magnetic layer ML1 is shown in FIGS. 4 to 6B.

Figure 4:
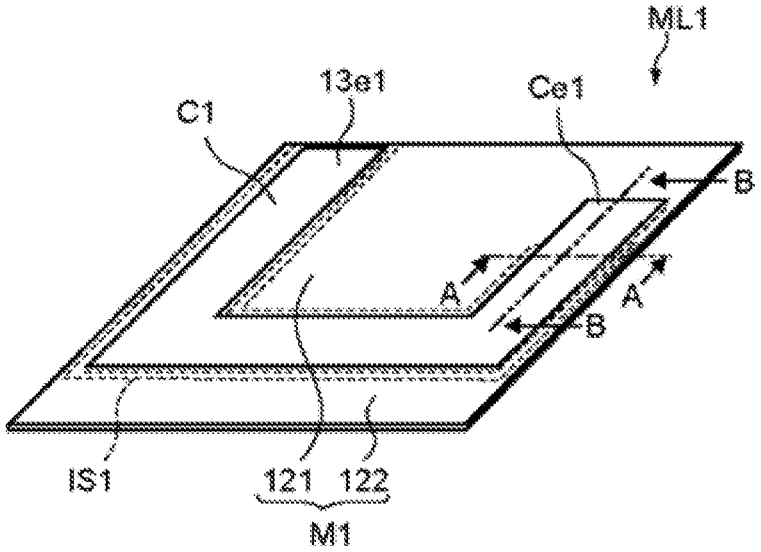
FIG. 4 is a rough perspective view showing the constitution of a magnetic layer in the coil component.
Figure 5:
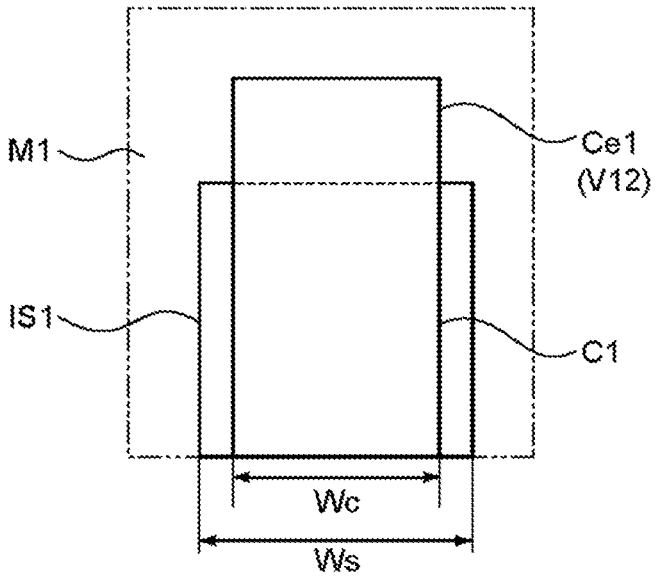
FIG. 5 is a plan view showing key parts of a winding part in the magnetic layer.
Figure 6A:
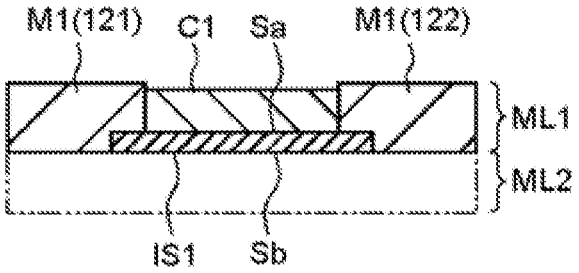
Figure 6B:
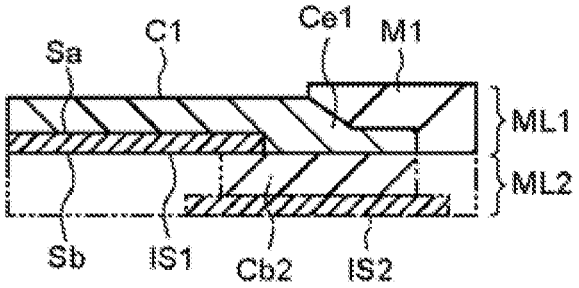
FIG. 6B is a cross sectional view of FIG. 4 along line B-B.

Here, FIG. 4 is a perspective view of the magnetic layer ML1. FIG. 5 is a plan view showing key parts of the connection end Ce1 of the winding part C1 in the magnetic layer ML1, FIG. 6A is a cross sectional view of FIG. 4 along line A-A, and FIG. 6B is a cross sectional view of FIG. 4 along line B-B.

The insulator parts IS1 to IS3 each have a width dimension equal to or greater than the width dimension of the winding parts C1 to C4 in their winding direction, and in this embodiment, each have a width dimension Ws greater than the width dimension Wc of the winding parts C1 to C4 (refer to FIGS. 3 and 5). This prevents short-circuiting between the winding parts as a result of the conductive material (conductor paste constituting the winding parts) seeping into the space between the magnetic alloy grains that constitute the magnetic part 12 adjoining the winding parts C1 to C4, and this allows desired dielectric strength to be ensured between these winding parts.

The ratio of the width dimension Wc of the winding part C1 and the width dimension Ws of the insulator part IS1 is not limited in any way, and the value of (Ws−Wc) may be 10 μm or more but no more than 80 μm, for example.

Figure 8:
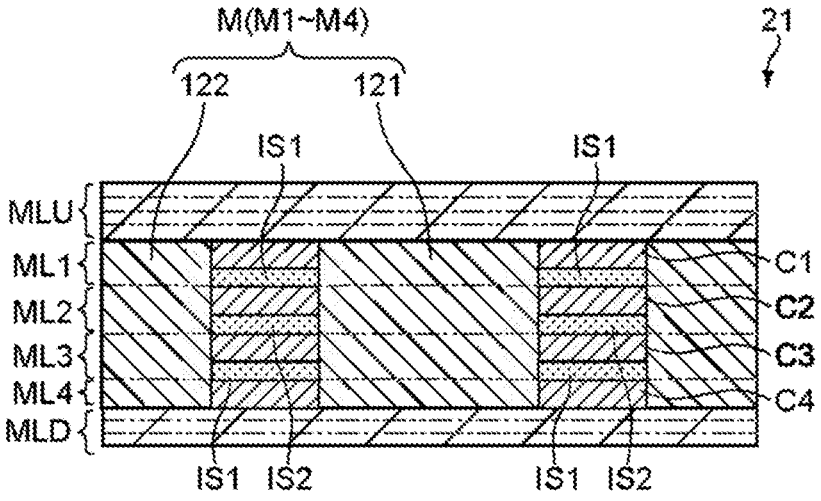
FIG. 8 is a cross sectional view of key parts showing an example of constitutional variation of the coil component.

As shown in FIG. 8, the insulator parts IS1 to IS3 may be constituted with the same width dimension as the width dimension of the winding parts C1 to C4. In this case, there is a concern that, when compared to the constitution shown in FIG. 3, the withstand voltage characteristics between the winding parts sandwiching the insulator parts IS1 to IS3 may drop and the magnetic characteristics (inductance characteristics) of the coil component as a whole may drop as a result; however, the DC superimposition characteristics of the coil component can be increased. In other words, the width dimension of the insulator parts IS1 to IS3 can be adjusted according to the specifications of the coil component, etc.

The thickness (thickness dimension in the Z-axis direction; the same applies hereinafter) of the insulator parts IS1 to IS3 is not limited in any way, and is set to any thickness as deemed appropriate that can ensure the specified dielectric strength between the winding parts. The thickness of the insulator parts IS1 to IS3 may be equal to or greater than the thickness of the winding parts C1 to C4, or smaller than the thickness of the winding parts C1 to C4.

In this embodiment, the insulator parts IS1 to IS3 are formed with a thickness smaller than that of the winding parts C1 to C4. Because the insulator parts IS1 to IS3 are formed with a thickness smaller than that of the winding parts C1 to C4, the component body 11 can be made thinner. Or, as the thickness of the winding parts C1 to C4 can be increased, the resistance of the winding parts C1 to C4 can be lowered.

In FIG. 6A, the top face of the insulator part IS1 constitutes a first joining surface Sa which is joined to the bottom face of the winding part C1, while the bottom face of the insulator part IS1 constitutes a second joining surface Sb which is joined to the top face of the magnetic layer ML2 (top face of the magnetic pattern part M2). The first joining surface Sa is joined to the entire area except for one end Ce1 of the winding part C1, to ensure electrical connection between the one end Ce1 of the winding part C1 and one end Cb2 of the winding part C2.

The insulator parts IS1 to IS3 are constituted by electrically insulating grains. The electrically insulating grains constituting the insulator parts IS1 to IS3 are not limited in any way, and they may be magnetic alloy grains, or silica grains, zirconium grains, alumina grains, ferrite grains, or other ceramic oxide grains. The electrically insulating grains include various magnetic alloy grains that bond with each other when heated and thus can constitute an insulator layer; ferrite grains and other ceramic oxide grains that are insulators to begin with and bond with each other when heated, upon which the grain boundaries are fused and grains are sintered together to constitute an insulation layer; and silica grains, zirconium grains, alumina grains, and other ceramic oxide grains that are insulators to begin with and remain in powder form even when heated.

As explained above, the electrically insulating grains include grains that have been bonded with each other due to heating. In other words, the insulator parts IS1 to IS3 are not limited to a mode where they are constituted by insulator grains directly, but there is also a mode where they are constituted by insulator grains that have been bonded with each other. Particularly in this embodiment, grains that hardly shrink or change volume when heated, are used. When the insulator parts IS1 to IS3 constituted by such grains are observed by SEM (scanning electron microscopy), individual grains, grains that have been bonded with each other, grains that have been sintered together, etc., are observed, along with voids that have been formed between grains. The voids may be filled with a binder or other material.

Ideally the insulator parts IS1 to IS3 do not change volume when heated. When the insulator parts IS1 to IS3 constitute layers that maintain high insulation and do not change volume even when heated, they can be formed as thin layers while ensuring sufficient insulation between the winding parts C1 to C4 without fail. For example, assume that the insulator parts IS1 to IS3 are constituted by a material that shrinks and also changes shape when heated, such as glass of low melting point; in this case, the insulator parts IS1 to IS3 can no longer be formed as thin layers because then sufficient insulation cannot be ensured between the winding parts C1 to C4, and consequently it is no longer possible to make the component thinner while ensuring sufficient magnetic characteristics at the same time.

For the magnetic alloy grains constituting the insulator parts IS1 to IS3 (first magnetic alloy grains), magnetic alloy grains of the same constitution as the magnetic alloy grains constituting the magnetic pattern parts M1 to M4 (magnetic part 12) (second magnetic alloy grains), or specifically FeCrSi magnetic alloy grains, may be used.

The average grain size of the magnetic alloy grains constituting the insulator parts IS1 to IS3 may be the same as, or different from, the average grain size of the magnetic alloy grains constituting the magnetic pattern parts M1 to M4. Typically for the magnetic alloy grains constituting the insulator part IS1, magnetic alloy grains with an average grain size equal to or less than the average grain size of the magnetic alloy grains constituting the magnetic pattern part M1 (such as 3 μm or less) are used; however, magnetic alloy grains with an average grain size of 1 μm or less can also be used.

The thickness of the insulator parts IS1 to IS3 constituted by magnetic alloy grains is 3 μm or more, for example. If the insulator parts IS1 to IS3 are constituted by magnetic alloy grains with an average grain size of 1 μm or less, then three or more magnetic alloy grains are arranged side by side in the thickness direction. The smaller the average grain size, the larger the specific surface area becomes, and therefore the contact area between the grain surface and the oxide film also increases, and consequently desired insulation characteristics can be ensured in a stable manner.

When silica grains, zirconium grains, alumina grains, ferrite grains, or other ceramic oxide grains are used as the electrically insulating grains constituting the insulator parts IS1 to IS3, the insulation characteristics of the insulator parts IS1 to IS3 can be improved further. This prevents dielectric breakdown that may otherwise be caused by an electric potential difference that applies between the conductors of the winding parts C1 to C4, and also allows the thickness of the insulator parts IS1 to IS3 to be reduced further. In addition, these types of ceramic grains are readily available in average grain sizes of 1 μm or less, which makes it possible to produce insulator parts IS1 to IS3 with a thickness of 2 μm or less, for example, in a stable manner.

On the other hand, magnetic alloy grains and ferrite grains are constituted by magnetic material, which means that using them as the electrically insulating grains suppresses drop in the magnetic characteristics of the coil component, even when the thickness and width dimensions of the insulator parts IS1 to IS3 are relatively large. Accordingly, sufficient insulation can be ensured without fail between the winding parts C1 to C4, and drop in the magnetic characteristics of the coil component can be suppressed at the same time, even when the width dimension Ws of the insulator parts IS1 to IS3 is greater than the width dimension of the winding parts C1 to C4.

[Method for Manufacturing the Coil Component]

The component body 11 is produced, as mentioned above, by stacking the magnetic layers MLU, ML1 to ML4, MLD, in their thickness direction. The magnetic layer MLU and magnetic layer MLD that constitute the top and bottom cover layers, respectively, are each constituted by a laminate comprising a specified number of magnetic sheets. On the other hand, the magnetic layers ML1 to ML4 that constitute the coil part 13 are produced individually according to the printing method, etc., for example.

Figure 7A:
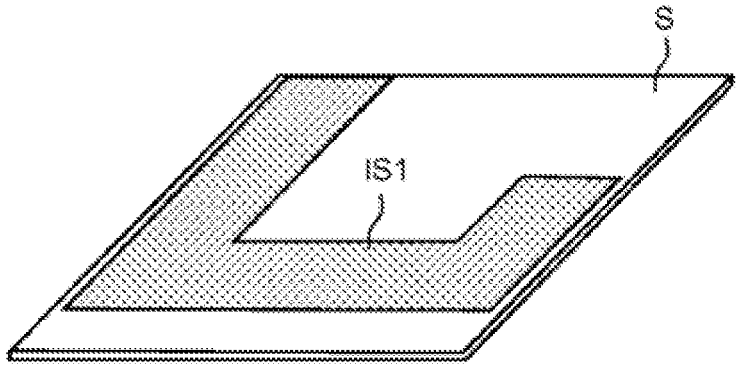
FIGS. 7A, 7B, and 7C are perspective views explaining how the magnetic layer is manufactured.
Figure 7B:
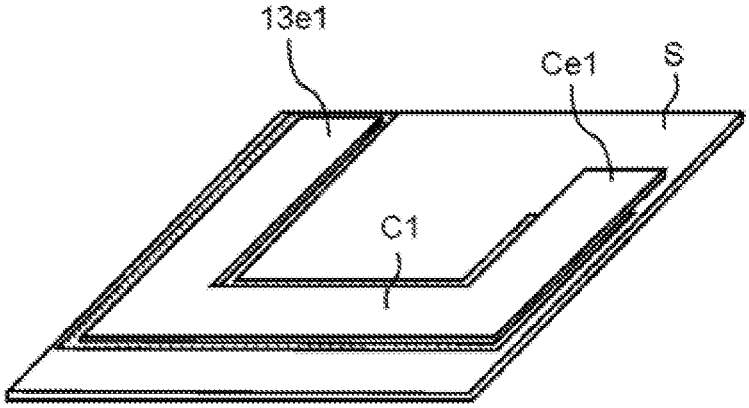
Figure 7C:
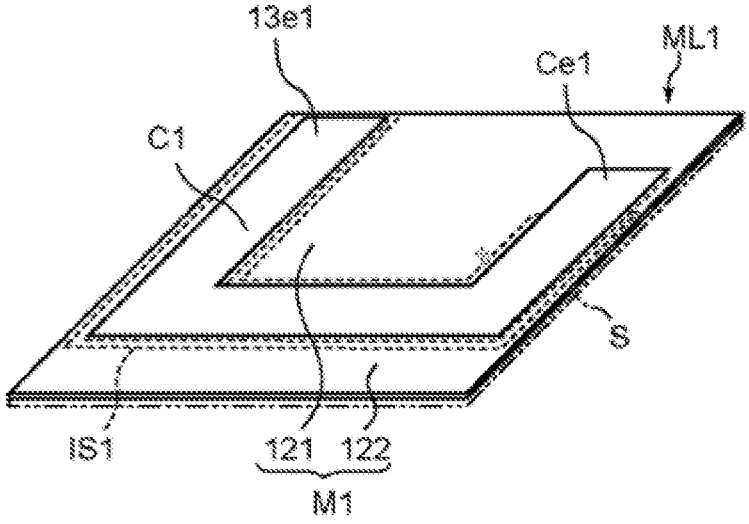

FIGS. 7A to 7C are perspective views explaining how the magnetic layer ML1 is manufactured.

For the production of the magnetic layer ML1, a support sheet S constituted by a PET (polyethylene terephthalate) or other resin sheet is used, as shown in FIG. 7A. And, on one side of this support sheet S, the insulator part IS1, winding part C1, and magnetic pattern part M1 are formed in sequence according to the screen printing method, for example, using the insulator paste, conductor paste, and magnetic paste, respectively, that have been prepared beforehand, to produce the magnetic layer ML1.

The insulator part IS1 is formed in the forming area of the winding part C1 on the support sheet S, in a winding shape corresponding to the winding part C1. Here, the insulator part IS1 has a wider shape than the winding part C1, and is provided over the entire area of the winding part C1 except for the one end Ce1 that will constitute a via V12 (FIG. 7A).

The winding part C1 is formed on the insulator part IS1 to the specified winding shape. Here, the winding part C1 is formed at the center of the insulator part IS1, with a width dimension We smaller than the width dimension Ws of the insulator part IS1 (refer to FIG. 5). Also, the one end Ce1 of the winding part C1 is formed on the support sheet S in a manner extending beyond the end of the insulator part IS1 by a specified length (refer to FIG. 6B).

Figure 9A:
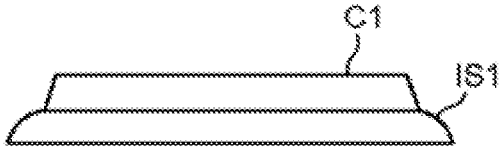
FIGS. 9A, 9B, and 9C are schematic views showing the relationship between the thickness of the insulator part and that of the winding part.
Figure 9B:
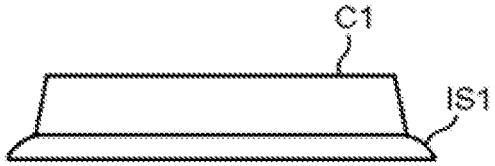
Figure 9C:
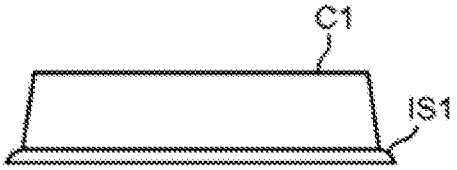

FIGS. 9A to 9C are schematic views illustrating the relationship between the thickness of the insulator part IS1 and that of the winding part C1. Here, FIG. 9A illustrates an example where the insulator part IS1 is formed with a thickness equal to that of the winding part C1, while FIGS. 9B, 9C illustrate examples where the insulator part IS1 is formed thinner than the winding part C1. Also, FIGS. 9A to 9C illustrate examples where the insulator part IS1 is formed with a width dimension greater than that of the winding part C1. The difference between the width of the insulator part IS1 and that of the winding part C1 is not limited in any way; as illustrated, however, the insulator part IS1 may be constituted in a manner projecting, by an amount corresponding to its thickness, from the side face of the winding part C1. In this case, the difference between the width of the insulator part IS1 and that of the winding part C1 is set smaller as the thickness of the insulator part IS1 decreases.

To make the thickness of the insulator part IS1 small, the smaller the average grain size of the grains constituting the insulator part IS1, the better. This is because when the average grain size is large, the thickness must be increased, and consequently the amount of projection from the side face of the winding part C1 increases. Also, the smaller the average grain size, the more uniform the thickness becomes, which allows for stable forming of the insulator part IS1.

The magnetic pattern part M1 is formed on the support sheet S in a manner adjoining the inner periphery parts and outer periphery parts of the insulator part IS1 and winding part C1. Here, the magnetic pattern part M1 covers both sides of the insulator part IS1 that are not covered with the winding part C1, as well as the specified area at the tip of the end Ce1 of the winding part C1.

It should be noted that, while FIGS. 7A to 7C show only a single magnetic layer ML1 for the purpose of illustration, in reality the support sheet S is formed to a size that allows multiple magnetic layers ML1 to be taken in-plane, which means that multiple magnetic layers ML1 will be formed on the same support sheet S through the aforementioned steps.

The magnetic layers ML2 to ML4 are also produced in the same manner as described above. It should be noted that, for the magnetic layer ML4, only the winding part C4 and magnetic pattern part M4 are produced, because the insulator layer need not be formed (refer to FIG. 2).

The magnetic layers MLU, MLD, ML1 to ML4 are stacked as shown in FIG. 2 and then thermally compressed together. Here, the support sheets S are separated and removed one by one as the magnetic layers ML1 to ML4 are layered. This way, the ends Ce1 to Ce4 of the winding parts C1 to C4 adjoining in the stacking direction are connected, respectively, to form the vias V12, V23, V34 (refer to FIG. 2).

The laminate of magnetic layers is cut to the component body size using a dicing machine, laser processing machine, or other cutting machine (not illustrated). The obtained component chip is heated in air or other oxidizing ambience using a sintering furnace or other heat treatment machine (not illustrated). This heat treatment includes a degreasing process and an oxide film forming process, where the degreasing process is implemented under the condition of approx. 300° C. for approx. 1 hour, while the oxide film forming process is implemented under the condition of approx. 700° C. for approx. 2 hours.

In the oxide film forming process following the degreasing process, the FeCrSi alloy grains in the magnetic material before heat treatment are densely aggregated to produce the magnetic part 12 (refer to FIG. 2), while at the same time an oxide film of these grains is formed on the surface of individual FeCrSi alloy grain. Also, the group of Ag grains in the coil part before heat treatment are sintered to produce the coil part 13 (refer to FIG. 2), while at the same time the magnetic pattern parts M1 to M4 of the magnetic layers ML1 to ML4 are integrated to produce one common magnetic pattern part M (refer to FIG. 3). As a result, the component body 11 is produced.

Next, a dip coater, roller coater, or other coater (not illustrated) is used to coat a conductor paste prepared beforehand on both ends of the component body 11 in the length direction, which is followed by heating at approx. 650° C. for approx. 20 minutes using a sintering furnace or other heat treatment machine (not illustrated), where the purpose of the heating is to eliminate the solvent and binder and sinter the group of Ag grains, to produce the external electrodes 14, 15 (refer to FIGS. 1, 2). Lastly, plating is performed. The plating is performed in the form of general electroplating, wherein a metal film of Ni and Sn is deposited on the external electrodes 14, 15 that have been formed earlier through sintering of the group of Ag grains. As a result, the coil component 10 is produced.

It should be noted that the magnetic layers ML1 to ML4 may be stacked one by one according to the build-up method. In this case, the magnetic layer ML4 is first produced on the support sheet, and on which ML4 the magnetic layer ML3, magnetic layer ML2 and magnetic layer ML1 are produced one by one. For the support sheet S of the magnetic layer ML4, the magnetic layer MLD constituting the bottom cover layer may be used.

With the coil component 10 in this embodiment as constituted above, the insulator parts IS1 to IS3 positioned between the multiple winding parts C1 to C4 facing in the Z-axis direction are constituted by single layers that are in turn constituted by electrically insulating grains, and therefore the component as a whole can be made thinner while at the same time ensuring sufficient electrical insulation between the winding parts C1 to C4.

Also, with the coil component 10 in this embodiment, the insulator parts IS1 to IS3 have winding shapes facing the winding parts C1 to C4 at least partially, and this makes it possible to constitute the areas on the inner periphery side and outer periphery side of the winding shapes with the magnetic alloy grains that constitute the magnetic part 12 (magnetic pattern parts M1 to M4). As a result, desired magnetic characteristics of the coil component 10 can be ensured.

According to this embodiment, the thickness dimension of the insulator parts IS1 to IS3 is smaller than the thickness dimension of the winding parts C1 to C4, and therefore the winding parts C1 to C4 can have a narrower pitch and the component can be made even thinner.

Also, use of magnetic alloy grains with an average grain size of 1 μm or less for the electrically insulating grains that constitute the insulator parts IS1 to IS3, improves the electrical insulation characteristics of the insulator parts IS1 to IS3, which in turn makes it possible to improve the dielectric strength between the winding parts C1 to C4 or make the pitch between the winding parts C1 to C4 even narrower, and consequently the component can be made thinner.

Furthermore, since the magnetic part 12 is constituted by magnetic alloy grains whose average grain size is larger than that of the magnetic alloy grains constituting the insulator parts IS1 to IS3, the magnetic characteristics of the magnetic part 12 can be improved. Or, because the magnetic characteristics of the magnetic part 12 improves, the thickness of the magnetic layers MLU, MLD constituting the top and bottom cover layers, respectively, can be reduced and the component can be made even thinner as a result.

EXAMPLES

Next, examples of the present invention are explained.

Example 1

The coil component shown in FIG. 3 (or FIG. 8) was produced according to the following conditions:

Magnetic Part

Size: Length 1000 μm, width 500 μm, height 499 μm

Magnetic alloy grains: FeSiCr (3.5 Si 4.5 Cr), average grain size 3 μm

Conductor Part (Winding Part)

Number of turns: 13.5 (16 layers)

Thickness: 9.0 μm

Width (Wc): 140 μm

Insulator Part

Constituent grains: Magnetic alloy grains (FeSiCr (3.5 Si 4.5 Cr)), average grain size 3 μm, thickness 13 μm Width (Ws): 218 μm Width difference (Ws−Wc): 78 μm The term "average grain size" indicates the average grain size (median size) on volumetric basis, and refers to, for example, the value along the distribution of grain sizes measured according to the laser-diffraction granularity distribution measurement method, corresponding to a cumulative percentage of 50% (D50).

Next, an impulse tester was used to measure the withstand voltage of the produced coil component. Under the measurement condition of 1.5 μsec in pulse width, the voltage that could be cleared by all 20 samples was evaluated. The result was 50 V.

Example 2

A coil component was produced under the same conditions as those in Example 1, except that the height of the magnetic part was set to 472 μm, the average grain size of magnetic alloy grains was set to 2 μm, the thickness of the conductor part was set to 12 μm, and the average grain size of the constituent grains, thickness, and width (Ws) of the insulator part were set to 2 μm, 8 μm, and 185 μm (width difference 45 μm), respectively. When the withstand voltage of the produced coil component was measured under the same condition as that in Example 1, the result was 50 V.

Example 3

A coil component was produced under the same conditions as those in Example 1, except that the height of the magnetic part was set to 474 μm, the average grain size of magnetic alloy grains was set to 1.5 μm, the thickness of the conductor part was set to 14 μm, and the average grain size of the constituent grains, thickness, and width of the insulator part were set to 1.5 μm, 6 μm, and 170 μm (width difference 30 μm), respectively. When the withstand voltage of the produced coil component was measured under the same condition as that in Example 1, the result was 50 V.

Example 4

A coil component was produced under the same conditions as those in Example 1, except that the height of the magnetic part was set to 429 μm, the average grain size of magnetic alloy grains was set to 1 μm, the thickness of the conductor part was set to 14 μm, and the average grain size of the constituent grains, thickness, and width of the insulator part were set to 1 μm, 3 μm, and 155 μm (width difference 15 μm), respectively. When the withstand voltage of the produced coil component was measured under the same condition as that in Example 1, the result was 50 V.

Example 5

A coil component was produced under the same conditions as those in Example 1, except that the height of the magnetic part was set to 405 μm, the average grain size of magnetic alloy grains was set to 5 μm, the thickness of the conductor part was set to 14 μm, and the average grain size of the constituent grains, thickness, and width of the insulator part were set to 1 μm, 3 μm, and 155 μm (width difference 15 μm), respectively. When the withstand voltage of the produced coil component was measured under the same condition as that in Example 1, the result was 50 V.

Example 6

A coil component was produced under the same conditions as those in Example 1, except that the height of the magnetic part was set to 382.5 μm, the average grain size of magnetic alloy grains was set to 5 μm, the thickness of the conductor part was set to 14 μm, and the constituent grains, thickness, and width of the insulator part were set to silica grains (average grain size 0.5 μm), 1.5 μm, and 150 μm (width difference 10 μm), respectively. When the withstand voltage of the produced coil component was measured under the same condition as that in Example 1, the result was 50 V.

Example 7

A coil component was produced under the same conditions as those in Example 1, except that the height of the magnetic part was set to 382.5 μm, the average grain size of magnetic alloy grains was set to 5 μm, the thickness of the conductor part was set to 14 μm, and the constituent grains, thickness, and width of the insulator part were set to silica grains (average grain size 0.05 μm), 1.5 μm, and 170 μm (ratio 21%), respectively. When the withstand voltage of the produced coil component was measured under the same condition as that in Example 1, the result was 50 V.

Example 8

A coil component was produced under the same conditions as those in Example 1, except that the height of the magnetic part was set to 494 μm, the average grain size of magnetic alloy grains was set to 5 μm, the thickness of the conductor part was set to 4 μm, and the average grain size of the constituent grains, thickness, and width of the insulator part were set to 5 μm, 18 μm, and 140 μm (width difference 0), respectively. When the withstand voltage of the produced coil component was measured under the same condition as that in Example 1, the result was 25 V.

The production conditions and withstand voltages in Examples 1 to 8 are summarized in Table 1.

| | Magnetic part | | | Insulator part | | | | Conductor part (winding part) | | Width | Change in resistance | |
|---|---|---|---|---|---|---|---|---|---|---|---|---|
| | Height [μm] | Material | Grain size [μm] | Material | Grain size [μm] | Thickness [μm] | Width (Ws) [μm] | Thickness [μm] | Width (Wc) [μm] | difference Ws − Wc [μm] | Percentage of Example 8 | Withstand voltage [V] |
| Example 1 | 499 | Alloy grains | 3 | Alloy grains | 3 | 13.0 | 218 | 9.0 | 140 | 78 | 49 | 50 |
| Example 2 | 472 | Alloy grains | 2 | Alloy grains | 2 | 8.0 | 185 | 12.0 | 140 | 45 | 37 | 50 |
| Example 3 | 474 | Alloy grains | 1.5 | Alloy grains | 1.5 | 6.0 | 170 | 14.0 | 140 | 30 | 31 | 50 |
| Example 4 | 429 | Alloy grains | 1 | Alloy grains | 1 | 3.0 | 155 | 14.0 | 140 | 15 | 31 | 50 |
| Example 5 | 405 | Alloy grains | 5 | Alloy grains | 1 | 3.0 | 155 | 14.0 | 140 | 15 | 31 | 50 |
| Example 6 | 382.5 | Alloy grains | 5 | Silica grains | 0.5 | 1.5 | 150 | 14.0 | 140 | 10 | 31 | 50 |
| Example 7 | 382.5 | Alloy grains | 5 | Silica grains | 0.05 | 1.5 | 150 | 14.0 | 140 | 10 | 31 | 50 |
| Example 8 | 494 | Alloy grains | 5 | Alloy grains | 5 | 18.0 | 140 | 4.0 | 140 | 0 | — | 25 |

As shown in Table 1, it was confirmed that a withstand voltage of 25 V or more could be obtained in general in Examples 1 to 8. Particularly in Examples 1 to 7 where the average grain size of the constituent grains of the insulator part was 3 μm or less, the withstand voltage was confirmed to be higher than in Example 8 where the average grain size was 5 μm, even though the thickness of the insulator part was smaller. This is probably because the smaller the average grain size of the constituent grains of the insulator part, the smoother the insulator part becomes and more uniform its thickness becomes.

Furthermore, in Examples 1 to 7 where the conductor part is thicker than in Example 8, a coil component whose resistance is lower than that in Example 8 can be produced. When the percentages of the DC resistances of the conductor parts in Examples 1 to 7 were measured relative to the DC resistance of the conductor part in Example 8, the results shown in Table 1 were obtained.

The above explained an embodiment of the present invention; however, the present invention is not limited to the aforementioned embodiment in any way, and it goes without saying that various changes may be made.

In the above embodiment, for example, the external electrodes 14, 15 were provided on the two opposing end faces of the component body 11 in the length direction; however, the present invention is not limited to this, and the external electrodes 14, 15 may be provided on the two opposing side faces of the component body 11 in the width direction.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-118681, filed Jun. 15, 2016, and No. 2017-095538, filed May 12, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

a magnetic part constituted by magnetic alloy grains;

a continuous conductor part constituted by multiply layered winding parts and being wound around a one axis inside the magnetic part, wherein the multiply layered winding parts are constituted by multiple winding parts each layered in a direction of the one axis; and multiple insulator parts, each insulator part:

being placed between two adjacent winding parts facing each other in the direction of the one axis;

having two joining surfaces that are at least partially joined to and in contact with, respectively, the two adjacent winding parts;

having a winding shape which is winding in a manner following along a winding shape of one of the two adjacent winding parts as viewed in the direction of the one axis; and being constituted by electrically insulating grains having an average grain size which is 3 μm or less and also equal to or less than an average grain size of the magnetic alloy grains of the magnetic part.

2. A coil component according to claim 1, wherein a thickness dimension of each of the multiple insulator parts in the direction of the one axis is smaller than a thickness dimension of each of the multiply layered winding parts in the direction of the one axis.

3. A coil component according to claim 1, wherein a width dimension of each of the multiple insulator parts measured perpendicularly to the direction of the one axis is equal to or greater than a width dimension of each of the multiple winding parts measured perpendicularly to the direction of the one axis.

4. A coil component, comprising:

a magnetic part constituted by magnetic alloy grains;

a continuous conductor part constituted by multiply layered winding parts and being wound around a one axis inside the magnetic part; and multiple insulator parts, each being placed between the multiply layered winding parts, each insulator part having a winding shape that includes two joining surfaces that are at least partially joined to and in contact with, respectively, two adjacent winding parts facing each other in a direction of the one axis, and each insulator part being constituted by electrically insulating grains, wherein a thickness dimension of each of the multiple insulator parts in the direction of the one axis is smaller than a thickness dimension of each of the multiply layered winding parts in the direction of the one axis, and wherein a width dimension of each of the multiple insulator parts measured perpendicularly to the direction of the one axis is equal to or greater than a width dimension of each of the multiple winding parts measured perpendicularly to the direction of the one axis.

5. A coil component according to claim 1, wherein the electrically insulating grains include first magnetic alloy grains having an average grain size of 1 μm or less.

6. A coil component according to claim 2, wherein the electrically insulating grains include first magnetic alloy grains having an average grain size of 1 μm or less.

7. A coil component according to claim 3, wherein the electrically insulating grains include first magnetic alloy grains having an average grain size of 1 μm or less.

8. A coil component according to claim 4, wherein the electrically insulating grains include first magnetic alloy grains having an average grain size of 1 μm or less.

9. A coil component according to claim 5, wherein the magnetic part is constituted by second magnetic alloy grains whose average grain size is larger than that of the first magnetic alloy grains.

10. A coil component according to claim 6, wherein the magnetic part is constituted by second magnetic alloy grains whose average grain size is larger than that of the first magnetic alloy grains.

11. A coil component according to claim 7, wherein the magnetic part is constituted by second magnetic alloy grains whose average grain size is larger than that of the first magnetic alloy grains.

12. A coil component according to claim 8, wherein the magnetic part is constituted by second magnetic alloy grains whose average grain size is larger than that of the first magnetic alloy grains.

13. A coil component according to claim 1, wherein the electrically insulating grains include silica grains, zirconium grains, or alumina grains with an average grain size of 1 μm or less.

14. A coil component according to claim 2, wherein the electrically insulating grains include silica grains, zirconium grains, or alumina grains with an average grain size of 1 μm or less.

15. A coil component according to claim 3, wherein the electrically insulating grains include silica grains, zirconium grains, or alumina grains with an average grain size of 1 μm or less.

16. A coil component according to claim 4, wherein the electrically insulating grains include silica grains, zirconium grains, or alumina grains with an average grain size of 1 μm or less.

17. A coil component according to claim 1, wherein the electrically insulating grains include ferrite grains.

18. A coil component according to claim 2, wherein the electrically insulating grains include ferrite grains.

19. A coil component according to claim 3, wherein the electrically insulating grains include ferrite grains.

* * * * *